US011857833B2

(12) United States Patent
Aoki et al.

(10) Patent No.: US 11,857,833 B2
(45) Date of Patent: Jan. 2, 2024

(54) FOOT-PEDALING EXERCISE APPARATUS

(71) Applicant: TOYOTA JIDOSHA KABUSHIKI KAISHA, Toyota (JP)

(72) Inventors: Eisuke Aoki, Toyota (JP); Fujio Ikeda, Toyota (JP); Tadashi Odashima, Toyota (JP); Takahiro Takeda, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/500,510

(22) Filed: Oct. 13, 2021

(65) Prior Publication Data

US 2022/0118309 A1 Apr. 21, 2022

(30) Foreign Application Priority Data

Oct. 15, 2020 (JP) ..... 2020-173882

(51) Int. Cl.

| | |
|---|---|
| ***A63B 22/18*** | (2006.01) |
| ***A63B 22/00*** | (2006.01) |
| ***A63B 21/00*** | (2006.01) |

(52) U.S. Cl.

CPC ..... *A63B 22/18* (2013.01); *A63B 21/4034* (2015.10); *A63B 22/0025* (2015.10); *A63B 2022/0038* (2013.01); *A63B 2022/185* (2013.01); *A63B 2208/0233* (2013.01)

(58) Field of Classification Search

CPC . A63B 22/18; A63B 21/4034; A63B 22/0025; A63B 2022/0038; A63B 2022/185; A63B 2208/0233; A63B 21/012; A63B 22/0664; A63B 22/203; A63B 22/04; A63B 22/0605; A63B 2022/0611

See application file for complete search history.

(56) References Cited

U.S. PATENT DOCUMENTS 4,185,622 A * 1/1980 Swenson ..... A61H 1/0266 601/31
5,562,574 A 10/1996 Miller
5,707,321 A 1/1998 Maresh
(Continued)

FOREIGN PATENT DOCUMENTS

CN 101618261 A 1/2010
CN 102847268 A 1/2013
(Continued)

OTHER PUBLICATIONS

PreStep, Sakaimed, accessed Aug. 24, 2021, https://www.sakaimed.co.jp/rehabilitation/exercise-therapy/care_prevention/pre-step/.
(Continued)

*Primary Examiner* — Garrett K Atkinson
(74) *Attorney, Agent, or Firm* — Dinsmore & Shohl LLP

(57) ABSTRACT

A foot-pedaling exercise apparatus by which a user can perform an effective foot-pedaling exercise is provided. A foot-pedaling exercise apparatus includes a crank, a main-body part configured to rotatably hold the crank, a link rotatably connected to the crank, the link including a pedal on which a sitting user puts his/her foot, a moving member disposed in the link, and a tilt table including an inclined surface on which the moving member slides.

5 Claims, 18 Drawing Sheets

(56) References Cited

U.S. PATENT DOCUMENTS 5,836,855 A * 11/1998 Eschenbach ..... A63B 22/0015 482/57
5,857,941 A * 1/1999 Maresh ..... A63B 22/001 482/52
5,879,271 A 3/1999 Stearns et al.
5,899,833 A * 5/1999 Ryan ..... A63B 24/00 482/52
5,997,445 A * 12/1999 Maresh ..... A63B 22/0664 482/70
6,248,046 B1 * 6/2001 Maresh ..... A63B 22/001 482/52
6,277,054 B1 * 8/2001 Kuo ..... A63B 22/001 482/57
6,340,340 B1 1/2002 Stearns et al.
6,648,800 B2 * 11/2003 Stearns ..... A63B 22/001 482/52
7,037,242 B2 * 5/2006 Lo ..... A63B 22/0664 482/52
7,182,714 B2 * 2/2007 Moon ..... A63B 22/208 482/52
7,201,705 B2 * 4/2007 Rodgers, Jr. ..... A63B 22/208 482/52
7,223,209 B2 * 5/2007 Lee ..... A63B 22/0664 482/52
7,402,126 B2 * 7/2008 Chang ..... A63B 69/18 482/52
7,462,135 B2 * 12/2008 Lo ..... A63B 22/001 482/52
7,674,205 B2 * 3/2010 Dalebout ..... A63B 22/001 482/52
7,896,780 B2 * 3/2011 Chen ..... A63B 23/0429 482/52
8,047,968 B2 * 11/2011 Stewart ..... A63B 22/0023 482/52
8,210,993 B2 * 7/2012 Lee ..... A63B 21/225 482/52
9,050,485 B2 * 6/2015 Huang ..... A63B 22/203
9,597,540 B2 * 3/2017 Arnold ..... A63B 22/201
10,695,607 B2 * 6/2020 Teal ..... A63B 21/227
2001/0011053 A1 8/2001 Miller
2004/0266588 A1 12/2004 Miller
2005/0003932 A1 * 1/2005 Chen ..... A63B 22/0015 482/52
2006/0046902 A1 * 3/2006 Chang ..... A63B 22/0664 482/52
2006/0172862 A1 8/2006 Badarneh et al.
2006/0223678 A1 10/2006 MacLean
2006/0252607 A1 11/2006 Holloway
2007/0060449 A1 * 3/2007 Lo ..... A63B 22/0023 482/52
2007/0238582 A1 * 10/2007 Lee ..... A63B 22/0015 482/52
2008/0161163 A1 7/2008 Stewart et al.
2009/0111663 A1 * 4/2009 Kuo ..... A63B 22/001 482/53
2009/0291808 A1 * 11/2009 Chen ..... A63B 23/0429 482/52
2010/0010397 A1 1/2010 Ochi et al.
2011/0086743 A1 * 4/2011 Stewart ..... A63B 22/0664 482/52
2011/0105280 A1 5/2011 Jhang et al.
2012/0115685 A1 * 5/2012 Bedell ..... A63B 22/0664 482/52
2014/0031175 A1 1/2014 Peralo
2014/0309086 A1 * 10/2014 Chuang ..... A63B 22/0015 482/57
2016/0107026 A1 4/2016 Hsu
2017/0252603 A1 9/2017 Wu
2018/0207474 A1 7/2018 Chen
2022/0193485 A1 6/2022 Aoki
2022/0331652 A1 10/2022 Aoki et al.
2022/0331653 A1 10/2022 Takeda et al.
2022/0331654 A1 10/2022 Takeda et al.
2022/0362628 A1 11/2022 Polinsky et al.
2022/0408927 A1 12/2022 Aoki et al.
2022/0409955 A1 12/2022 Aoki
2023/0146049 A1 5/2023 Aoki et al.
2023/0148907 A1 5/2023 Aoki et al.
2023/0149776 A1 5/2023 Aoki et al.
2023/0149777 A1 5/2023 Aoki et al.

FOREIGN PATENT DOCUMENTS

CN 111530022 A 8/2020
JP H11-503660 A 3/1999
JP 2006-526456 A 11/2006
JP 4015941 B2 11/2007
JP 2008-104869 A 5/2008
JP 3165317 U 1/2011
JP 5319110 B2 10/2013
JP 3210988 U 6/2017
JP 2019-111213 A 7/2019
WO 9728848 A1 8/1997
WO 2004-108223 A1 12/2004

OTHER PUBLICATIONS

Inter Reha, Cognitive training ergometer cognitive bike, accessed Aug. 30, 2021, https://www.irc-web.co.jp/cognibike.
"PreStep COP-STEP", SAKAIMED, https://www.sakaimed.co.jp/rehabilitation/exercise-therapy/care_prevention/pre-step/, searched on Dec. 9, 2020.
Non-Final Office Action dated Jun. 1, 2023, Issued to related U.S. Appl. No. 17/553,266, filed Dec. 16, 2021.

* cited by examiner

FOOT-PEDALING EXERCISE APPARATUS

CROSS REFERENCE TO RELATED APPLICATIONS

This application is based upon and claims the benefit of priority from Japanese patent application No. 2020-173882, filed on Oct. 15, 2020, the disclosure of which is incorporated herein in its entirety by reference.

BACKGROUND

The present disclosure relates to a foot-pedaling exercise apparatus.

Non-patent Literature 1 (https://www.sakaimed.co.jp/rehabilitation/exercise-therapy/care_prevention/pre-step/) discloses an exercise apparatus by which a user can perform an upper/lower limbs cooperative exercise while sitting therein. In the exercise apparatus disclosed in Non-patent Literature 1, a user performs an exercise along an elliptical trajectory by pressing pedals. Patent Literature 1 (Published Japanese Translation of PCT International Publication for Patent Application, No. H11-503660) discloses an exercise apparatus by which a user performs stepping motions in a standing position.

SUMMARY

A user performs a foot-pedaling exercise in order to maintain or increase his/her muscular strength. It has been desired to enable a user to exercise more effectively in such an exercise apparatus. For example, there has been a demand that an appropriate movable range should be able to be set for a joint according to the user. In the exercise apparatus disclosed in Non-patent Literature 1, it is difficult to enable a user to perform a foot-pedaling exercise in a state in which the movable range of foot joints (which are also referred to as ankle joints) are appropriately set.

The present disclosure has been made in view of the above-described background and an object thereof is to provide a foot-pedaling exercise apparatus by which a user can effectively perform a foot-pedaling exercise.

A first exemplary aspect is a foot-pedaling exercise apparatus including: a crank; a main-body part configured to rotatably hold the crank; a link rotatably connected to the crank, the link including a pedal on which a sitting user puts his/her foot; a moving member disposed in the link; and a tilt table including an inclined surface on which the moving member moves In the above-described foot-pedaling exercise apparatus, the tilt table may be disposed to be movable in a front-rear direction.

In the above-described foot-pedaling exercise apparatus, the tilt table may be disposed in such a manner that the tilt table can be replaced, and the tilt table including the inclined surface having a different inclination angle and a different shape may be attached thereto.

In the above-described foot-pedaling exercise apparatus, the crank, the link, and the moving member may be provided for each of left and right feet of the user, and at least one of a front-rear position, an inclination angle, and a shape of a left tilt table may be different from that of a right tilt table.

In the above-described foot-pedaling exercise apparatus, the moving member may include a sliding wheel configured to slide on the inclined surface.

According to the present disclosure, an object is to provide a foot-pedaling exercise apparatus by which a user can effectively perform a foot-pedaling exercise.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Figure 1:
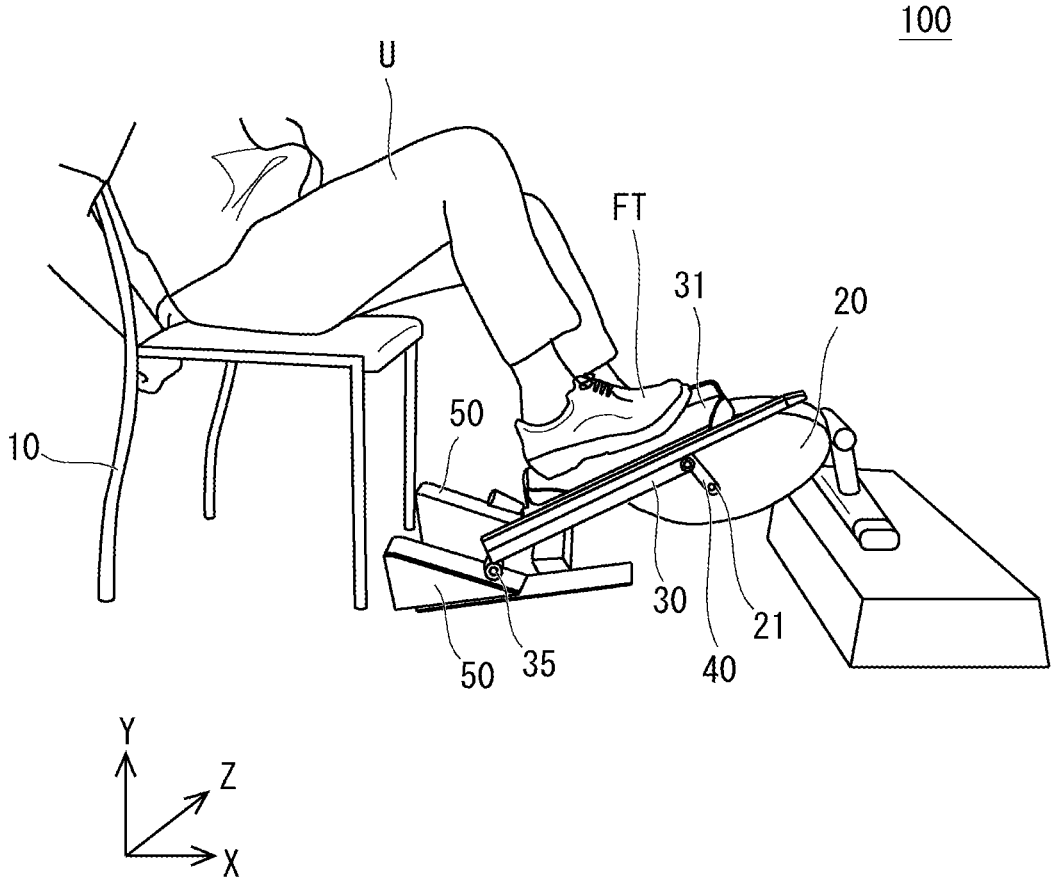
FIG. 1 is a perspective view schematically showing a configuration of an exercise apparatus.

The present disclosure will be explained hereinafter through embodiments according to the present disclosure. However, the below-shown embodiments are not intended to limit the scope of the present disclosure specified in the claims. Further, not all of the components/structures described in the embodiments are necessarily indispensable for solving the problem. For clarifying the explanation, the following description and the drawings are partially omitted and simplified as appropriate. The same reference numerals (or symbols) are assigned to the same elements throughout the drawings and redundant explanations thereof are omitted as appropriate.

First Embodiment

Figure 2:
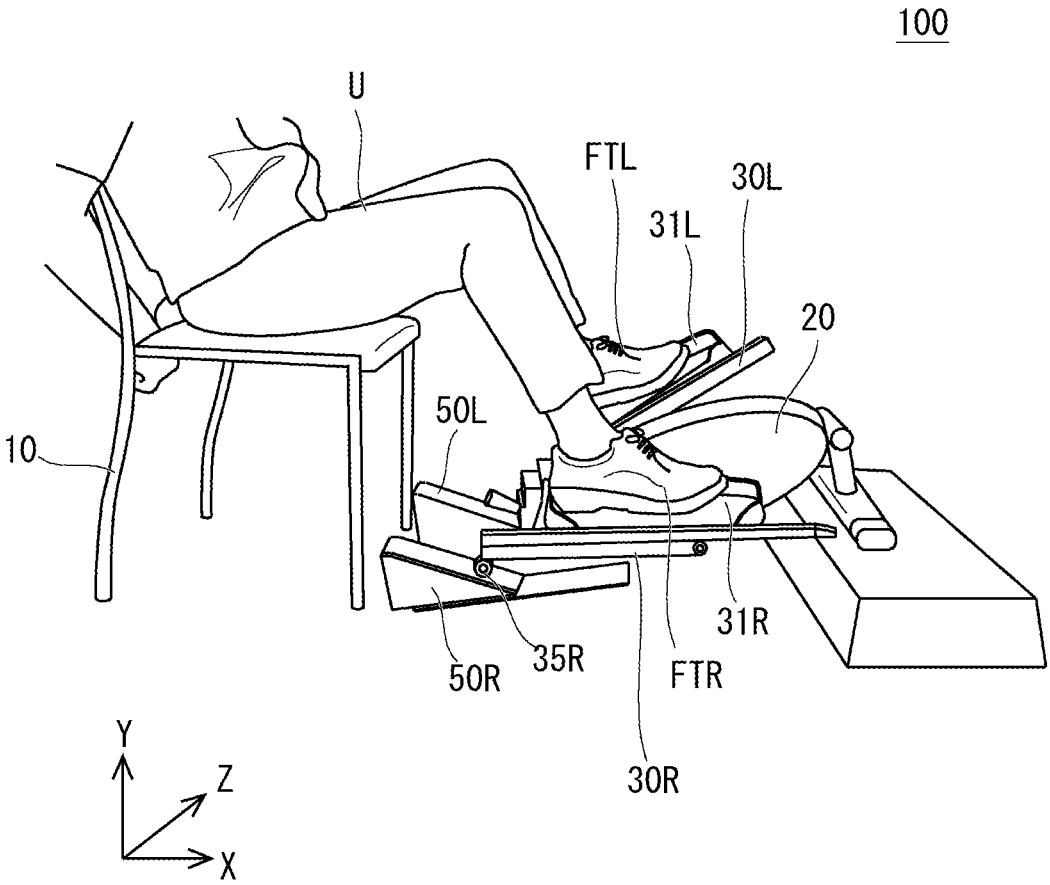
FIG. 2 is a perspective view schematically showing the configuration of the exercise apparatus.

An exercise apparatus according to an embodiment is a foot-pedaling exercise apparatus by which a user performs a foot-pedaling exercise. An exercise apparatus 100 according to this embodiment will be described with reference to FIGS. 1 and 2. FIGS. 1 and 2 are side views of the exercise apparatus 100. Note that, for clarifying the explanation, the following description is given while using an XYZ 3D (three-dimensional) orthogonal coordinate system. Specifically, the +X direction is the forward direction; the −X direction is the rearward direction; the +Y direction is the upward direction; the −Y direction is the downward direction; the +Z direction is the leftward direction; and the −Z direction is the rightward direction. The front-rear direction, the left-right direction, and the up-down direction are directions based on the direction of a user U.

The exercise apparatus 100 is one in which the movable ranges of ankle joints can be adjusted. In the following description, the rotational direction of an ankle joint about the Z-axis is referred to as a plantar/dorsi-flexion direction and the angle thereof is referred to as a plantar/dorsi-flexion angle. More specifically, a direction in which the toe of a foot FT points downward is referred to as a plantar-flexion direction, and a direction in which the toe points upward is referred to as a dorsiflexion direction.

As shown in FIG. 1, the exercise apparatus 100 includes a main-body part 20, links 30, a crank 40, and tilt tables 50. A chair 10 is provided behind the exercise apparatus 100. A user U performs a foot-pedaling exercise while sitting on the chair 10. Therefore, the chair 10 serves as a sitting part on which the user U sits. Note that the chair 10 may be provided integrally with the exercise apparatus 100 (i.e., provided as a part of the exercise apparatus 100), or may be provided as separate equipment. For example, the chair 10 may be a chair present in an institution where the user U is present, the user's house, or the like. That is, the user U or his/her assistant may place such a chair 10 behind the exercise apparatus 100.

Note that, in the exercise apparatus 100, the components attached to the main-body part 20 are symmetrical in the left-right direction. In FIG. 2, in order to distinguish the components on the left side of the main main-body part 20 from those on right side thereof, the components on the left side are indicated by a suffix "L" and those on the right side are indicated by a suffix "R". For example, in FIG. 2, the left tilt table 50 is referred to as a tilt table 50L, and the right tilt table 50 is referred to as a tilt table 50R. Similarly, the left link 30 and the left pedal 31 are referred to as a link 30L and a pedal 31L, respectively, and the right link 30 and the right pedal 31 are referred to as a link 30R and a pedal 31R, respectively. Similarly, the left foot FT is referred to as a left foot FTL, and the right foot FT is referred to as a right foot FTR. Note that, in the following description, when the left and right components are not distinguished from each other, the suffixes L and R are omitted.

The main-body part 20 rotatably holds the crank 40. For example, a rotation shaft 21 is provided in the main-body part 20. The crank 40 is connected to the rotation shaft 21. The crank 40 rotates about the rotation shaft 21. The main-body part 20 may include a resistive load member that gives a load to the rotational movement of the crank 40. Further, the main-body part 20 may include a gear or the like that changes the amount of the load. The main-body part 20 may be fixed to a floor surface.

Each of the links 30 includes a pedal 31 and a sliding wheel 35. The crank 40 is connected to the front end of each of the links 30, and the sliding wheel 35 is connected to the rear end of the link 30. The crank 40 and the links 30 are rotatably connected to each other. For example, each of the links 30 is attached to the crank 40 with a bearing or the like interposed therebetween. The pedal 31 is attached to the middle of the link 30. The pedal 31 is a step (a footrest) on which the user U puts his/her foot FT. The user U, who sits on the chair, puts the feet FT on the pedals 31.

The sliding wheel 35 is attached to the link 30 through a rotation shaft (an axle). That is, the link 30 rotatably holds the sliding wheel 35. The sliding wheel 35 serves as a moving member that moves on an inclined surface 51 of the tilt table 50 (In this specification, the meaning of the term "sliding" includes movements in which the sliding wheel 35 moves on the surface while rotating thereon).

The user U puts his/her feet FT on the pedals 31 and performs a foot-pedaling exercise. That is, the user U moves his/her knee joints and the hip joints so that the user U presses the pedals with his/her feet FT. In this way, the crank 40 rotates about the rotation shaft 21. Further, the angle between each of the links 30 and the crank 40 changes according to the rotation of the crank 40. That is, the relative angle of each of the links 30 with respect to the crank 40 changes according to the rotation angle of the crank 40 (which is also referred to as a crank angle). Further, the sliding wheel 35 moves in the front-rear direction while remaining in contact with the inclined surface 51. In this way, the crank 40 and each of the links 30 are rotated in such a manner that the pedal 31 moves along an elliptical trajectory according to the foot-pedaling motion.

Note that the pedal 31, the sliding wheel 35, the link 30, the crank 40, and the tilt table 50 are provided for each of the left and right feet FT of the user U. That is, the pedal 31, the sliding wheel 35, the link 30, the crank 40, and the tilt table 50 are provided on each of the left and right sides of the main-body part 20. The pedal 31R, the sliding wheel 35R, the link 30R, the tilt table 50R, and the like provided on the right side of the main-body part 20 correspond to the right foot FTR of the user U. The pedal 31L, the link 30L, and the tilt table 50L provided on the left side of the main-body part 20 correspond to the left foot FTL of the user U.

The cranks 40 are attached to the rotation shaft 21 of the main-body part 20 in such a manner that the phases thereof for the left and right feet FT are opposite to each other. That is, the rotation angle of the crank 40 for the left foot and that of the crank 40 for the right foot are shifted from each other by 180°. The user U performs a foot-pedaling exercise by stretching and bending the left and the right legs in an alternating manner.

The sliding wheel 35 is attached to the lower end of the link 30. The sliding wheel 35 has a wheel that slides on the inclined surface of the tilt table 50. The tilt table 50 has the inclined surface which is inclined so that the tilt table 50 becomes higher toward the rear thereof. The sliding wheel 35 performs a reciprocating movement in the X-direction (the front-rear direction) according to the rotational movement of the link 30. As shown in FIG. 1, while the user U performs a foot-pedaling motion by stretching the right leg and bending the left leg, the sliding wheel 35 on the right side moves forward and the sliding wheel 35 on the left side moves rearward. As shown in FIG. 2, while the user U performs a foot-pedaling motion by stretching the left leg and bending the right leg, the sliding wheel 35 on the left side moves forward and the sliding wheel 35 on the right side moves rearward.

The height of the sliding wheel 35 changes along the inclined surface of the tilt table 50. The inclined surface of the tilt table 50 becomes higher toward the rear thereof. That is, the tilt table 50 becomes an upslope for the sliding wheel 35 that is moving rearward. Therefore, while the sliding wheel 35 is moving rearward, the position of the sliding wheel 35 is gradually raised. On the other hand, while the sliding wheel 35 is moving forward, the position of the sliding wheel 35 is gradually lowered. The angle of the link 30 is determined according to the height of the sliding wheel 35.

Note that the angle of the pedal 31 disposed in the link 30 is restricted according to the height of the sliding wheel 35. That is, when the sliding wheel 35 is raised, the pedal 31 rotates in the plantar-flexion direction. When the sliding wheel 35 is lowered, the pedal 31 rotates in the dorsiflexion direction. Therefore, it is possible to adjust the movable range of the plantar/dorsi-flexion angle of the ankle joint according to the inclination angle of the tilt table 50. It is possible to adjust the movable range of the plantar/dorsi-flexion angle of the ankle joint according to the rotation angle of the crank 40.

Figure 3:
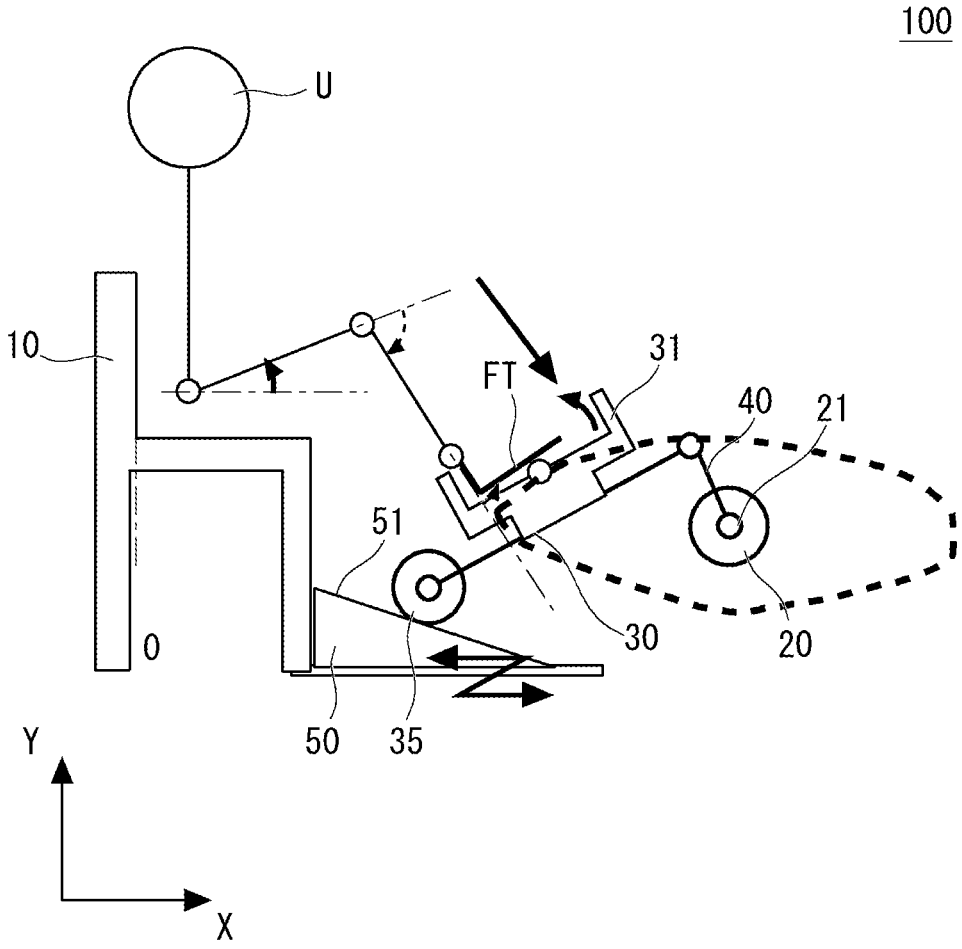
FIG. 3 is a side view schematically showing the configuration of the exercise apparatus.
Figure 4:
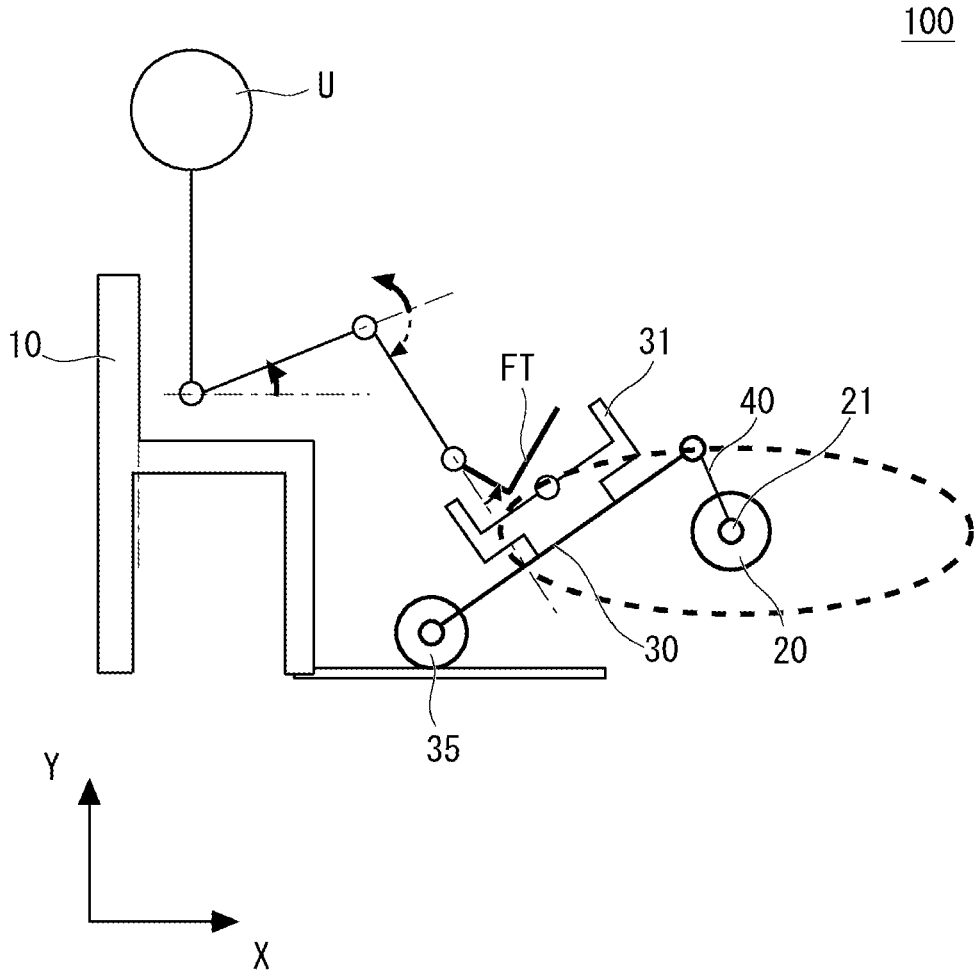
FIG. 4 is a side view schematically showing the configuration of the exercise apparatus.

This feature will be described hereinafter with reference to FIGS. 3 and 4. FIGS. 3 and 4 are side views schematically showing the configuration of the exercise apparatus 100. FIG. 3 shows a configuration of the exercise apparatus 100 in which the tilt table 50 is provided, and FIG. 4 shows a configuration thereof in which no tilt table 50 is provided.

In FIG. 3, the height of the sliding wheel 35 changes along the inclined surface 51 of the tilt table 50. The angle of the link 30 changes according to the height of the sliding wheel 35. Since the foot FT is put on the pedal 31 disposed in the link 30, the joint angle of the foot FT changes according to the angle of the link 30. As the sliding wheel 35 moves rearward, the sliding wheel 35 is raised and the ankle joint rotates in the plantar-flexion direction. Further, as the sliding wheel 35 moves forward, the sliding wheel 35 is lowered and the ankle joint rotates in the dorsiflexion direction. According to this embodiment, it is possible to adjust the movable range of the ankle joint in the plantar/dorsi-flexion direction according to the inclination angle of the tilt table 50. That is, each user U can perform a foot-pedaling exercise at an ankle-joint angle(s) suitable for that user U.

In contrast, in FIG. 4, since no tilt table 50 is provided, the height of the sliding wheel 35 is constant. That is, even when the sliding wheel 35 moves rearward, the height of the sliding wheel 35 does not change. Therefore, in the configuration shown in FIG. 4, it is difficult to adjust the movable range of the ankle joint in the plantar/dorsi-flexion direction on a user-by-user basis.

In this embodiment, since the tilt table 50, on which the sliding wheel 35 moves, is provided, the movable range in the plantar/dorsi-flexion direction can be easily adjusted. That is, it is possible to set an optimum movable range according to the user U. Specifically, by making the tilt table 50 movable in the front-rear direction, it is possible to change the relation between the position of the sliding wheel 35 in the X direction and the height of the sliding wheel 35. In this way, it is possible easily change and adjust the movable range.

For example, it is possible to adjust the ankle-joint angle in the plantar-flexion direction by moving the tilt table 50 forward. Further, the ankle-joint angle is adjusted in the dorsiflexion direction by moving the tilt table 50 rearward. For example, in the case of an elderly user, the tilt table 50 may be set so that the movable range of the ankle joint is reduced.

It is possible to reproduce the plantar/dorsi-flexion movement of an ankle similar to the motion thereof during actual walking, and therefore to reproduce a motion similar to that performed in actual walking in rehabilitation. The ankle is dorsiflexed when the knee is extended (i.e., the leg is stretched) in the swing-leg state, and the ankle is plantar-flexed in the second half of the stance-leg state. Further, when the swing leg is switched, the ankle is immediately dorsiflexed. By using the tilt table, it is possible to reproduce the motion of the ankle performed during actual walking by the exercise apparatus 100.

Further, it is possible to determine which region of the plantar-flexion region or the dorsiflexion region of the ankle is mainly moved. For example, assume an example case where the user U is a patient who feels a pain when his/her ankle is dorsiflexed and feels no pain when the ankle is plantar-flexed. Although it is difficult for this user U to perform a dorsiflexion motion, he/she can easily perform a plantar-flexion motion. Therefore, the user U can move the ankle joint within a range in which he/she feels no pain. Accordingly, the user U can perform rehabilitation without anxiety.

Figure 5:
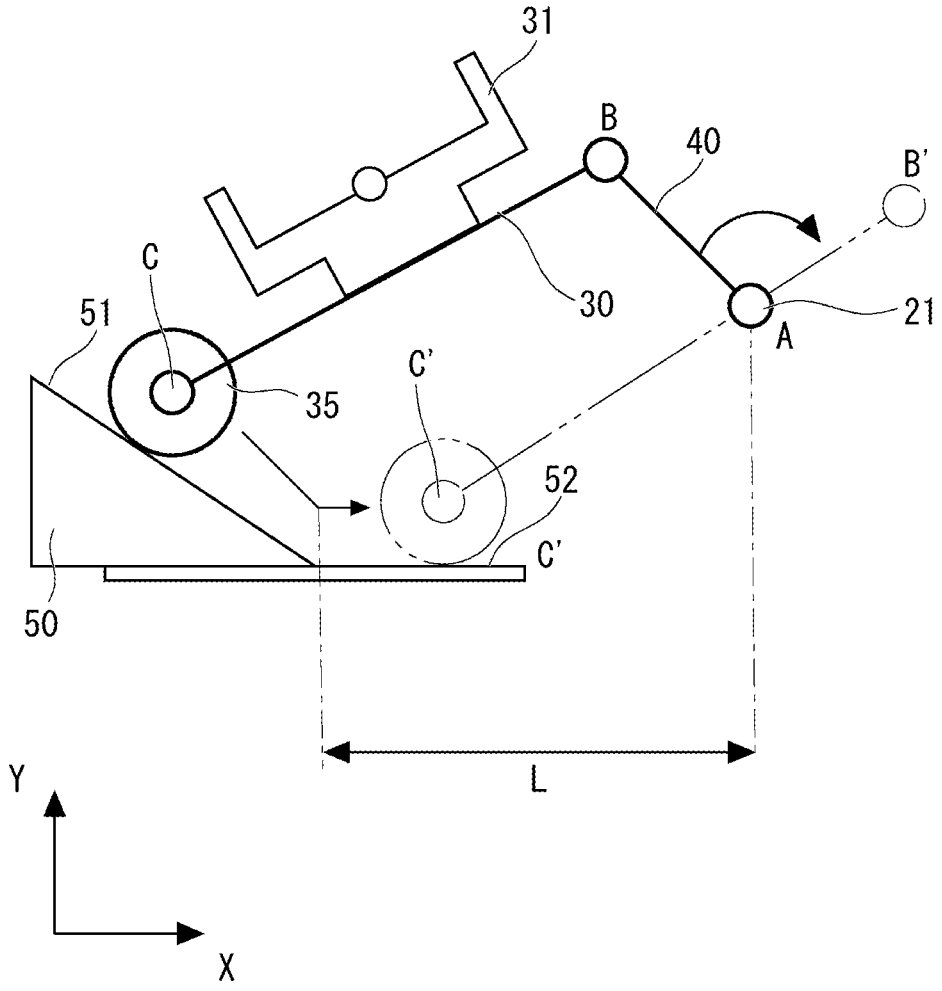
FIG. 5 is a side view for explaining a positional relation between a tilt table and a sliding wheel.

The movable range of the ankle-joint angle when the tilt table 50 is moved forward or rearward will be described hereinafter in detail with reference to FIG. 5. FIG. 5 is a side view schematically showing the main part of the exercise apparatus 100. In FIG. 5, the rotation shaft 21 about which the crank 40 rotates relative to the main-body part 20 is referred to as a rotation shaft A, and the rotation shaft at the connecting part between the crank 40 and the link 30 is referred to as a rotation shaft B. Further, the axle of the sliding wheel 35 is referred to as a rotation shaft C. Further, the distance from the rotation axis A to the front end of the tilt table 50 in the X direction is represented by L. It is assumed that a horizontal floor surface 52 is provided in front of the inclined surface 51.

It is assumed that when the distance L is smaller than Lmin, the sliding wheel 35 moves on the inclined surface 51 in the whole range of crank angles. When the distance L is larger than Lmax, the sliding wheel 35 moves on the horizontal floor surface 52 in the whole range of crank angles. That is, when the distance L is larger than Lmax, the configuration of the exercise apparatus 100 is the same as the configuration in which no the tilt table 50 is provided (i.e., the configuration shown in FIG. 4), and the height of the sliding wheel 35 is constant at all times. When the distance L is neither smaller than Lmin nor larger than Lmax, the sliding wheel 35 moves on the inclined surface 51 in a part of the range of crank angles and moves on the horizontal floor in the remaining part of the range of crank angles.

Note that Lmin and Lmax are determined according to the lengths of the crank 40 and the link 30. In an XY-plane view, the distance L becomes Lmin when all the rotation shafts A, B and C are located on one straight line; the length AC is minimized (AC=BC−AB) (which is indicated by the positions of B' and C' in FIG. 5); and the sliding wheel 35 is in contact with the front end of the tilt table 50. In the XY-plane view, the distance L becomes Lmax when all the rotation shafts A, B and C are located on one straight line; the length AC is maximized (AC=BC+AB); and the sliding wheel 35 is in contact with the front end of the tilt table 50.

Figure 6:
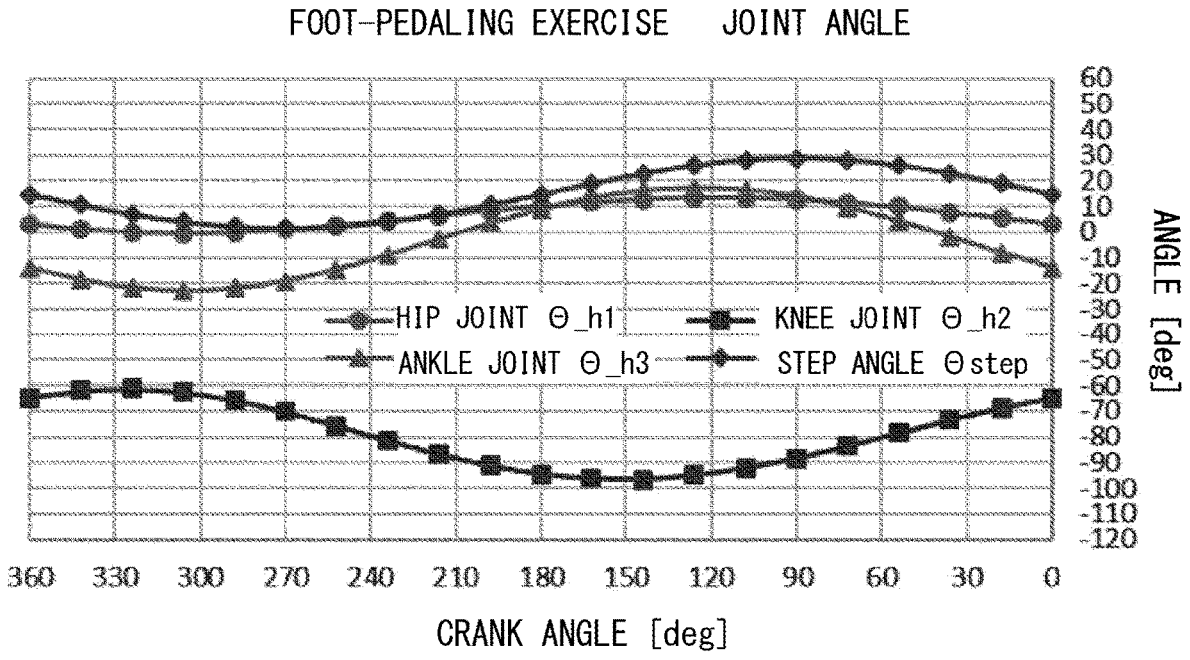
FIG. 6 is a graph showing joint angles in the case where no tilt table is provided.
Figure 7:
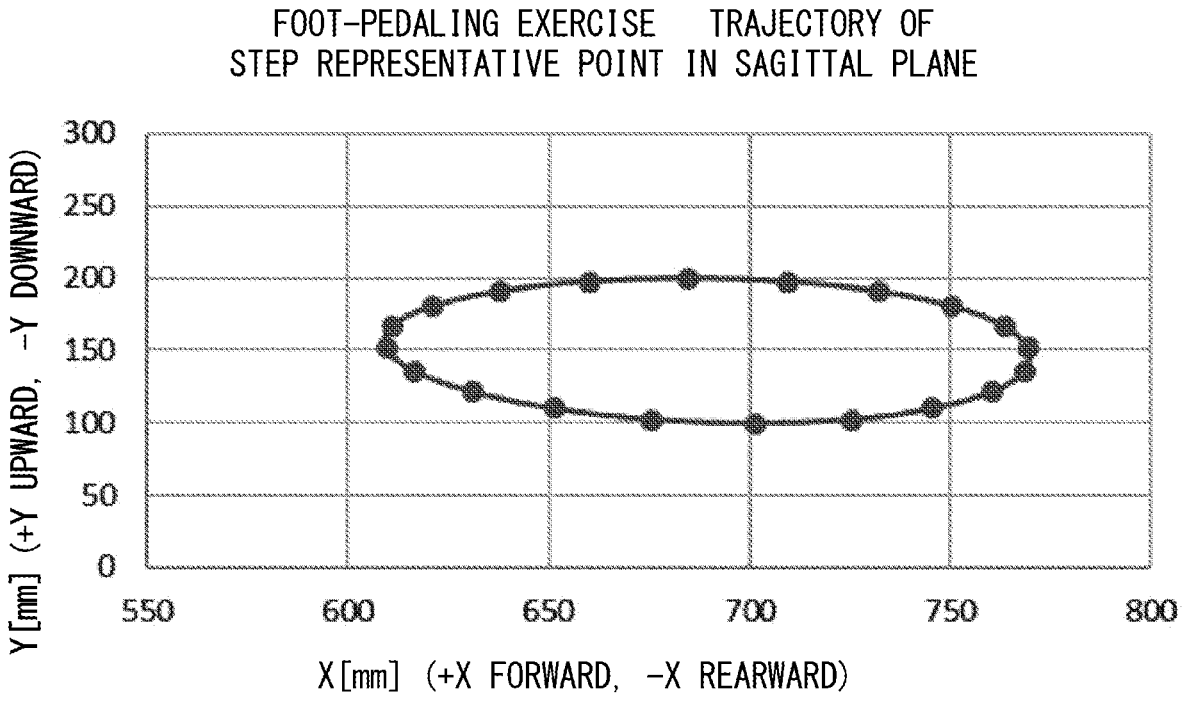
FIG. 7 shows a trajectory of a representative point in the case where no tilt table is provided.
Figure 8:
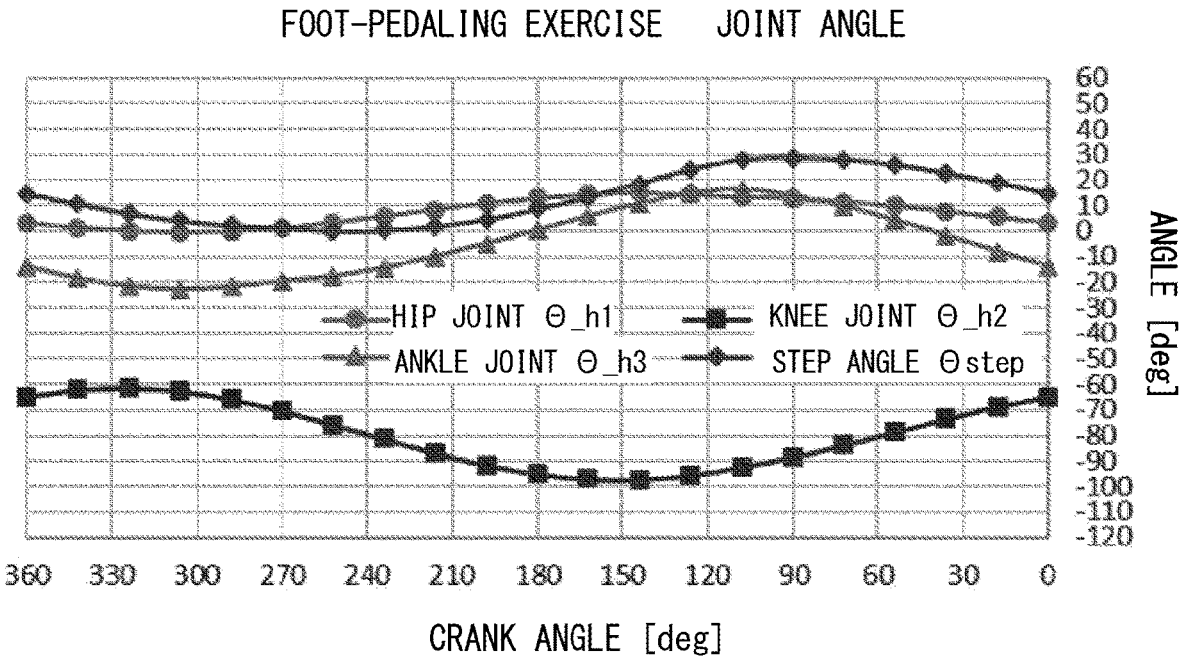
FIG. 8 is a graph showing joint angles when a sliding wheel slides on a tilt table in a part of the range of rotation angles.
Figure 9:
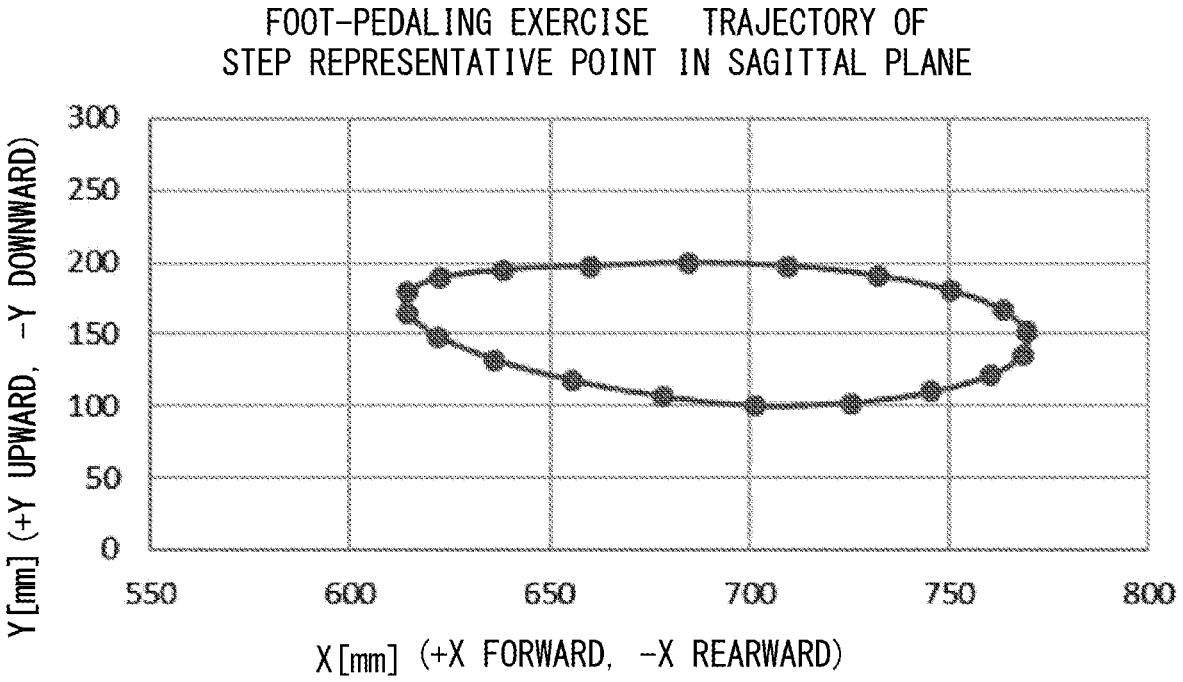
FIG. 9 shows a trajectory of a representative point when a sliding wheel slides on a tilt table in a part of the range of rotation angles.
Figure 10:
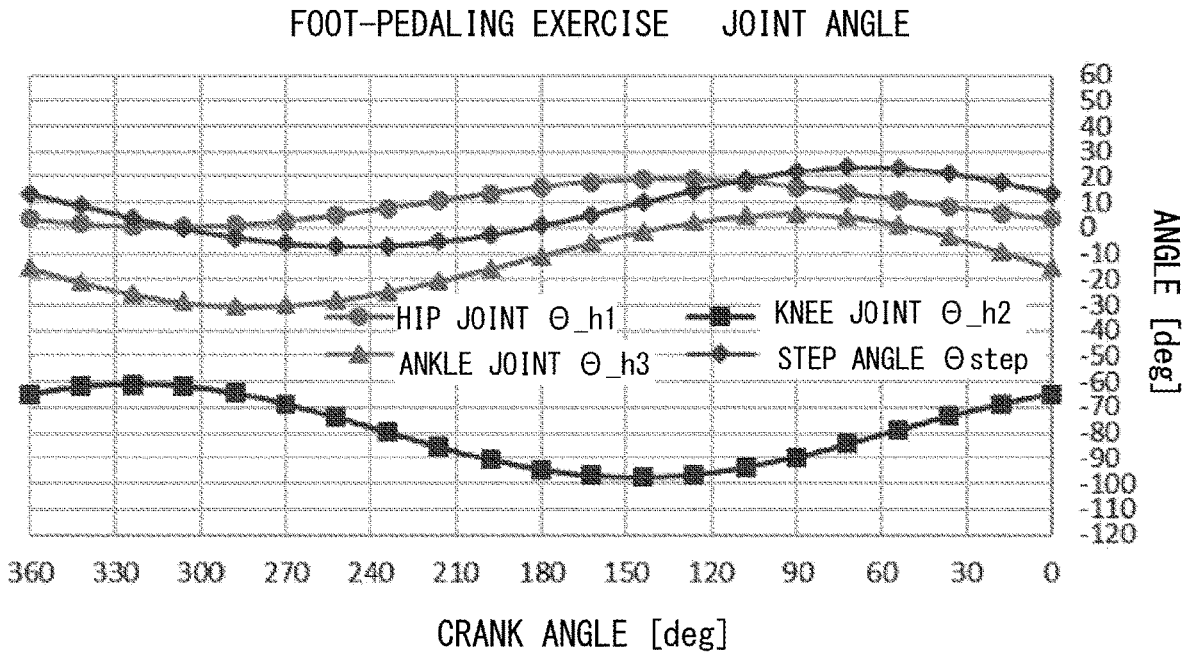
FIG. 10 is a graph showing joint angles when a sliding wheel slides on a tilt table in the whole range of rotation angles.
Figure 11:
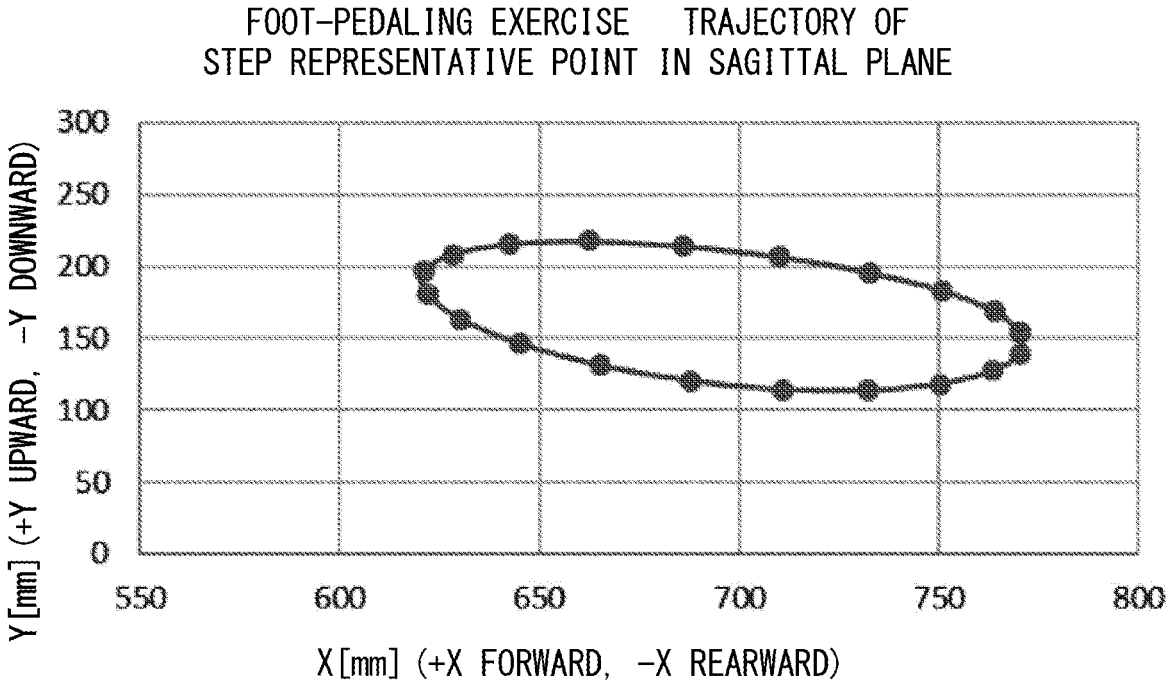
FIG. 11 shows a trajectory of a representative point when a sliding wheel slides on a tilt table in the whole range of rotation angles.

Here, FIGS. 6 to 11 show results of simulations that are performed under the condition that the inclination angle of the tilt table 50 is set to 24.5°. FIGS. 6 and 7 show results in cases where the sliding wheel 35 moves on the horizontal floor surface, i.e., where the distance L is larger than Lmax. FIGS. 8 and 9 show results in cases where the sliding wheel 35 moves on the tilt table 50 in a part of the range of crank angles, i.e., where the distance L is neither smaller than Lmin nor larger than Lmax. FIGS. 10 and 11 show results in cases where the sliding wheel 35 moves on the tilt table 50 at all times, i.e., where the distance L is smaller than Lmin.

Each of FIGS. 6, 8, and 10 is a graph showing changes in the hip-joint angle, the knee-joint angle, the ankle-joint angle, and the angle of the pedal 31. In each of FIGS. 6, 8 and 10, the horizontal axis indicates the crank angle. Each of FIGS. 7, 9 and 11 shows a trajectory of a representative point of the step (the pedal 31) on the XY-plane.

Note that results of simulations that were performed under the condition that Lmax=425.5 mm and Lmin=259.8 mm are shown. In FIGS. 6 and 7, results of simulations in which L=450 mm are shown. In FIGS. 8 and 9, results of simulations in which L=350 mm are shown. In FIGS. 10 and 11, results of simulations in which L=250 mm are shown.

As shown in FIGS. 6 to 11, it is possible to change the movable range of the ankle joint by moving the tilt table 50 forward or backward. In other words, it is possible to change the position of the tilt table 50 in the front-rear direction according to the state of the ankle joint of the user U. The user U can effectively perform a foot-pedaling exercise. For example, in the case of a rehabilitation patient or an elderly person, the movable range of the ankle joint may be smaller than that of healthy people. For such users, the position of the tilt table 50 in the front-rear direction is determined so that the movable range is reduced. Further, even for the same user U, it is possible to adjust the movable range according to the condition of the user U. For example, it is possible to adjust the movable range according to the level of the recovery of a rehabilitation patient.

Note that, in the above description, the movable range of an ankle joint was adjusted by moving the tilt table 50 in the front-rear direction. However, the method for adjusting the movable range is not limited to this example method. For example, a plurality of tilt tables 50 having different inclination angles may be prepared. It is possible to adjust the inclination angle by using the plurality of tilt tables 50 that can be replaced with one another. A user U, an assistant, or the like can adjust the movable range by replacing the tilt table 50 with one having an appropriate inclination angle. The ankle-joint angle can be adjusted in the plantar-flexion direction by replacing the tilt table 50 with one having a larger inclination angle. The ankle-joint angle can be adjusted in the dorsiflexion direction by replacing the tilt table 50 with one having a smaller inclination angle.

Alternatively, the tilt table 50 may be divided into a plurality of blocks, and the movable range may be adjusted by changing the number of blocks and/or the size of blocks. For example, the movable range can be adjusted by stacking a plurality of blocks on top of one another. Needless to say, the movable range may be adjusted by combining two or more of the above-described adjustment methods with each other.

Note that although the inclination angle of the tilt table 50 is constant in the drawings, the inclination angle of the tilt table 50 may be changed as desired. For example, the inclined surface 51 may be formed as a curved surface such as a concave surface or a convex surface. That is, in an XZ-plane view, the inclined surface 51 may not be a straight line, but may be a curved line such as a curved line according to a quadratic function. In this way, it is possible to set the movable range of an ankle-joint angle more finely.

Further, at least one of the front-rear position, the inclination angle, and the shape of the left tilt table 50L may be different from that of the right tilt table 50R. For example, in the case of a patient having an injury in his/her left leg, it is more difficult for the patient to move the ankle of the injured left leg than to move the ankle of the uninjured right leg. In such a case, the patient can do rehabilitation while adjusting the movable range of the injured leg to a range smaller than that of the uninjured leg. Alternatively, the patient can do rehabilitation while adjusting the movable range of the injured leg to a range larger than that of the uninjured leg.

Note that although the sliding wheel 35 is provided as a moving member that moves on the tilt table 50 in the above description, a moving member other than the sliding wheel 35 may be used. For example, a slide member that slides on the tilt table 50 may be used as the moving member. That is, the moving member may slide on the tilt table 50 rather than rotating thereon.

Further, a material having a high friction coefficient may be used for at least one of the inclined surface 51 and the moving member. That is, a frictional resistance may be given between the inclined surface 51 and the moving member. In this way, it is possible to increase the load to the foot-pedaling exercise, so that a user can perform an effective exercise. Further, the resistive force by the friction may be a directional resistive force. For example, the resistive force to the forward movement of the moving member may be different from the resistive force to the rearward movement thereof. In this way, it is possible to adjust the load to the foot-pedaling exercise more finely.

Second Embodiment

Figure 12:
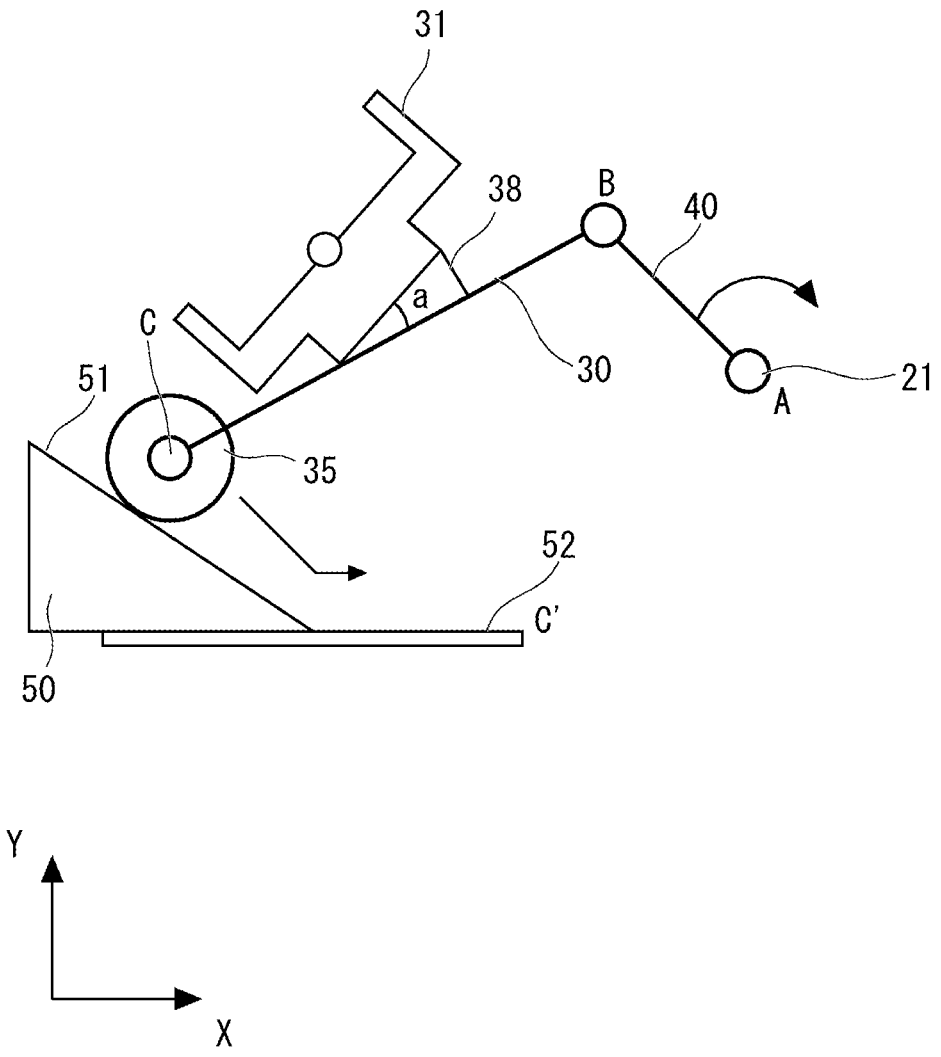
FIG. 12 is a schematic diagram showing a configuration of an exercise apparatus according to a second embodiment.

An exercise apparatus 100 according to another embodiment will be described with reference to FIG. 12. FIG. 12 is an XY-plane view schematically showing a configuration of the main part of the exercise apparatus 100. In this embodiment, an adjustment member 38 is added. The configuration other than the adjustment member 38 is similar to that of the first embodiment, and therefore the description thereof will be omitted.

The adjustment member 38 is disposed between the pedal 31 and the link 30. The adjustment member 38 is a wedge-like member. The wedge angle $\alpha$ of the adjustment member 38 is, for example, 25°. By inserting the adjustment member 38 between the pedal 31 and the link 30, the pedal 31 can be inclined in the dorsiflexion direction. Since the ankle-joint angle changes according to the angle of the disposition of the pedal 31, the ankle joint can be inclined in the dorsiflexion direction at an angle larger than that in the first embodiment.

Further, it is possible to adjust the ankle-joint angle by preparing a plurality of adjustment members 38 having different angles. An assistant or the like may replace (i.e., select) the adjustment member 38 according to the user U. For example, the assistant or the like can further incline the ankle joint in the dorsiflexion direction by replacing the adjustment member 38 with one having a larger wedge angle $\alpha$. Needless to say, the adjustment member 38 may be disposed so that the ankle-joint angle is inclined in the plantar-flexion direction. For example, the wedge-like adjustment member 38 may be inserted in the opposite direction. Further, the shape of the adjustment member 38 is not limited to the wedge-like shape. That is, the adjustment member 38 may have various shapes.

Figure 13:
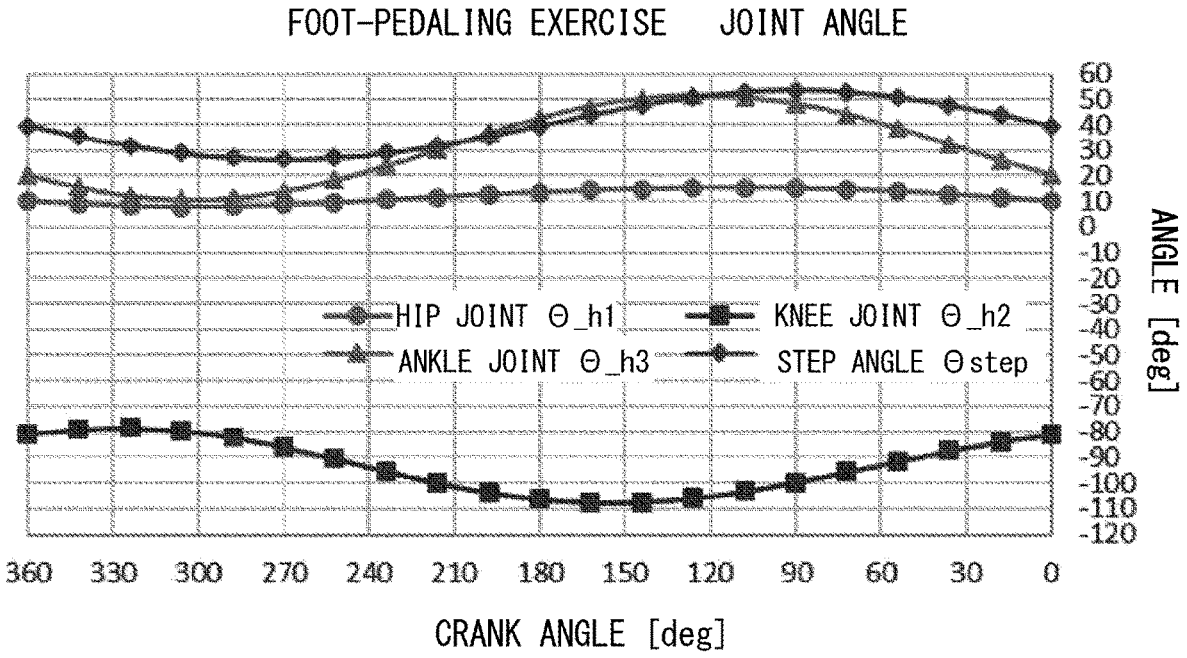
FIG. 13 is a graph showing joint angles in the case where no tilt table is provided.
Figure 14:
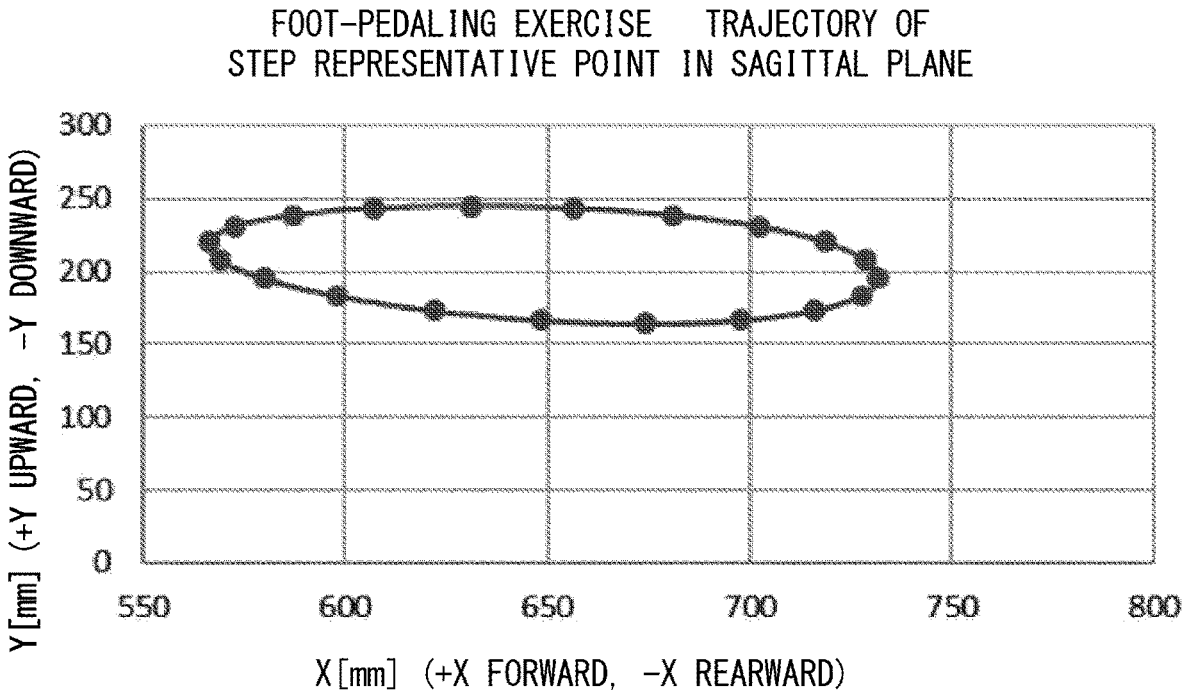
FIG. 14 shows a trajectory of a representative point in the case where no tilt table is provided.
Figure 15:
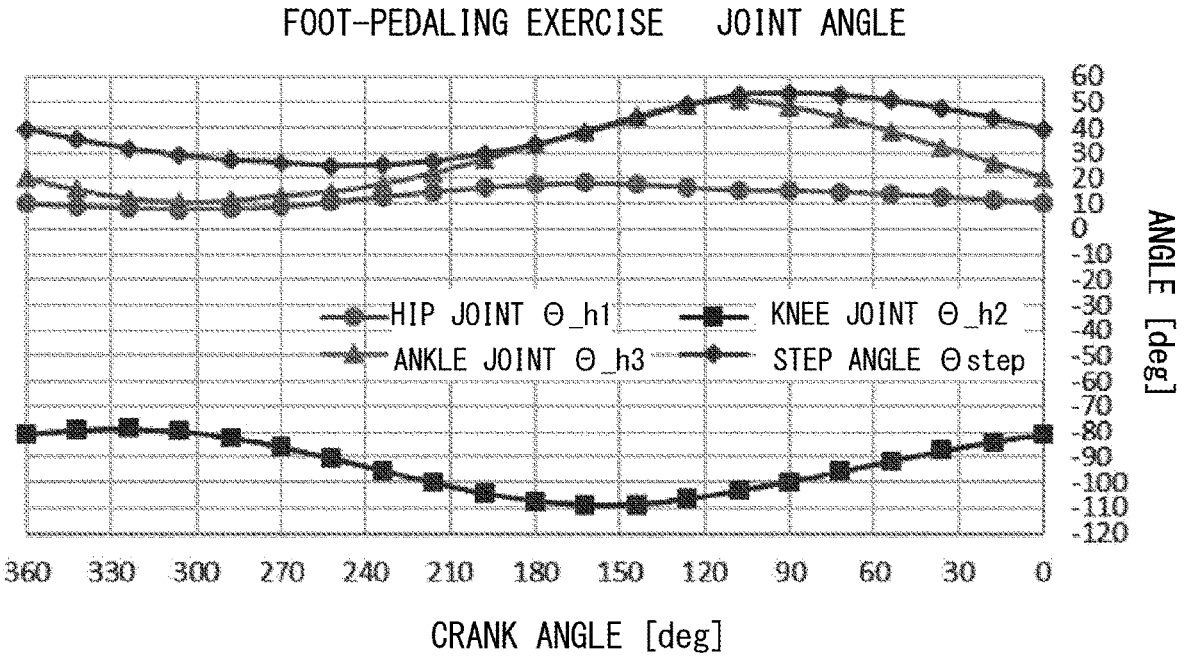
FIG. 15 is a graph showing joint angles when a sliding wheel slides on a tilt table in a part of the range of rotation angles.
Figure 16:
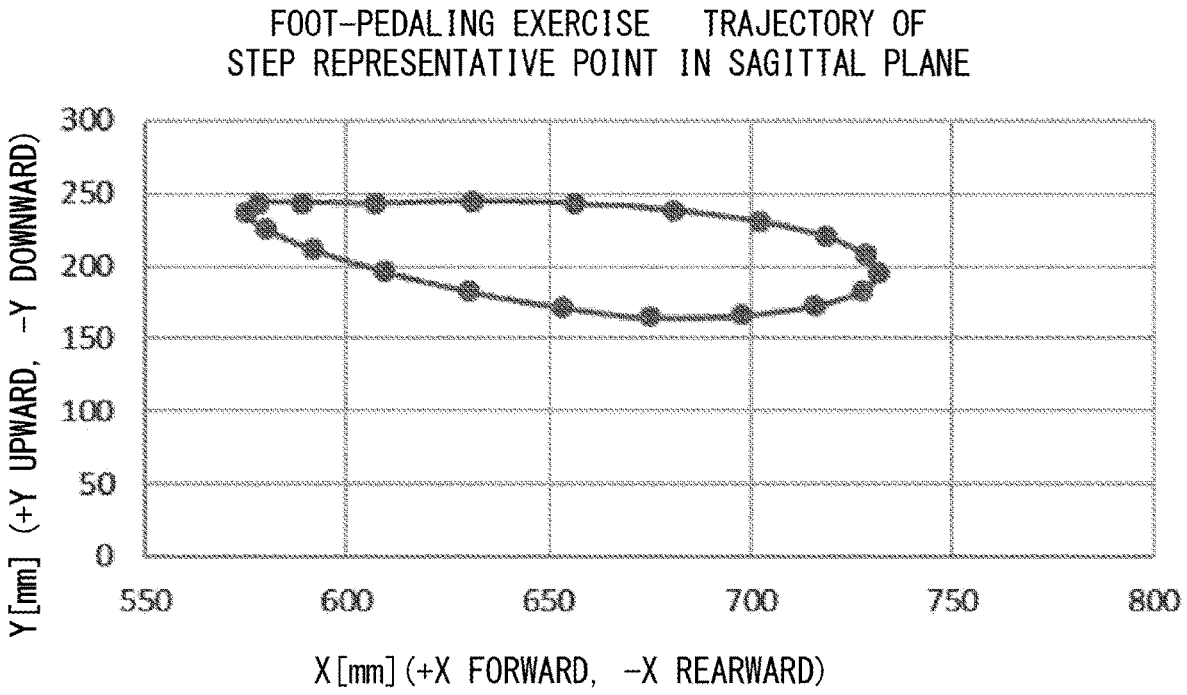
FIG. 16 shows a trajectory of a representative point when a sliding wheel slides on a tilt table in a part of the range of rotation angles.
Figure 17:
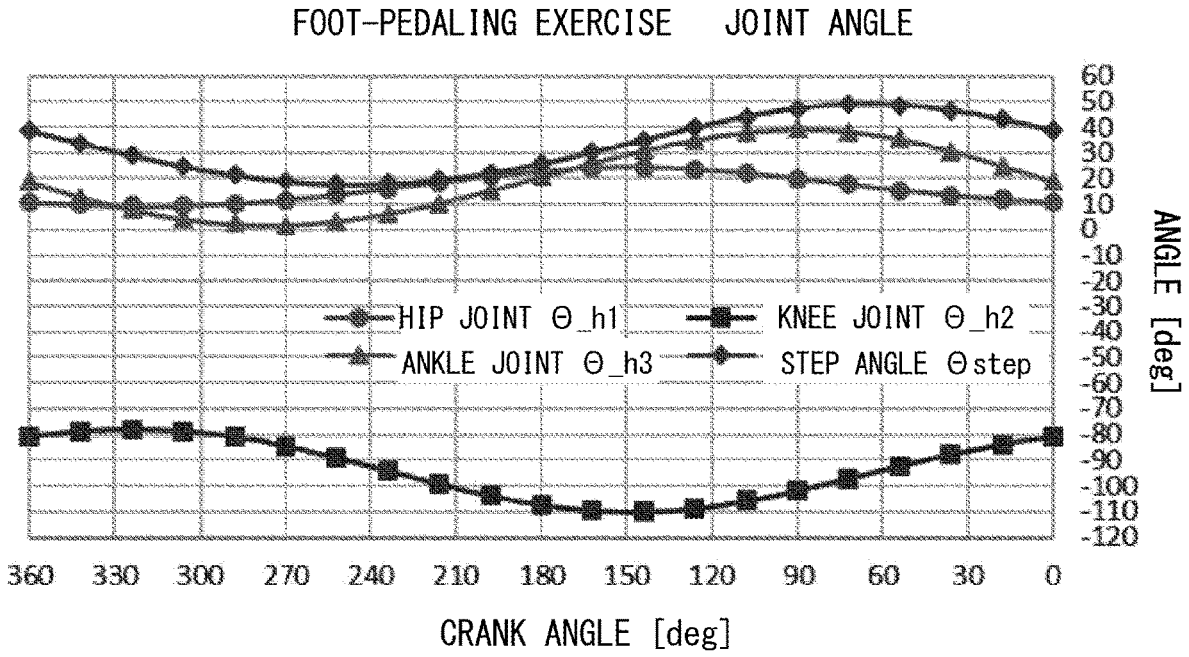
FIG. 17 is a graph showing joint angles when a sliding wheel slides on a tilt table in the whole range of rotation angles.
Figure 18:
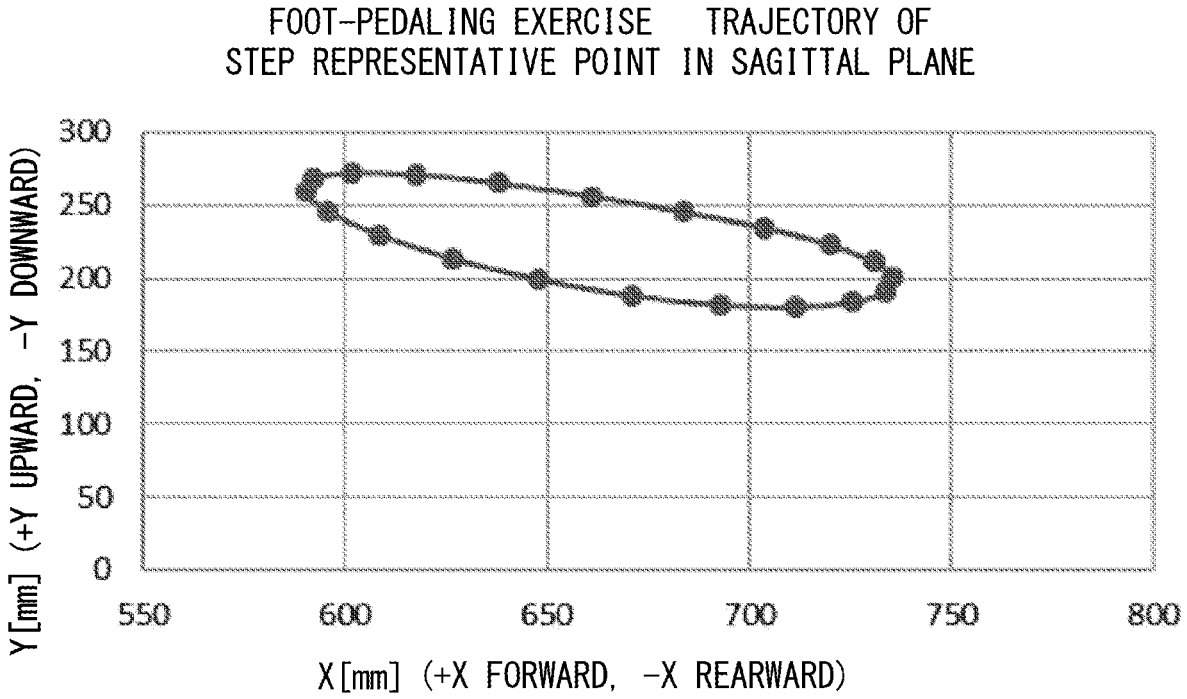
FIG. 18 shows a trajectory of a representative point when a sliding wheel slides on a tilt table in the whole range of rotation angles.

Here, FIGS. 13 to 18 show results of simulations that are performed under the condition that the inclination angle of the tilt table 50 is set to 24.5° and the wedge angle α is set to 25°. FIGS. 13 and 14 show results in cases where the sliding wheel 35 moves on the horizontal floor surface, i.e., where the distance L is larger than Lmax. FIGS. 14 and 16 show results in cases where the sliding wheel 35 moves on the tilt table 50 in a part of the range of crank angles, i.e., where the distance L is neither smaller than Lmin nor larger than Lmax. FIGS. 17 and 18 show results in cases where the sliding wheel 35 moves on the tilt table 50 at all times, i.e., where the distance L is smaller than Lmin.

Each of FIGS. 13, 15, and 17 is a graph showing changes in the hip-joint angle, the knee-joint angle, the ankle-joint angle, and the angle of the pedal 31. In each of FIGS. 13, 15 and 17, the horizontal axis indicates the crank angle. Each of FIGS. 14, 16 and 18 shows a trajectory of a representative point of the step (the pedal 31) on the XY-plane.

Note that results of simulations that were performed under the condition that Lmax=425.5 mm and Lmin=259.8 mm are shown. In FIGS. 13 and 14, results of simulations in which L=450 mm are shown. In FIGS. 15 and 16, results of simulations in which L=350 mm are shown. In FIGS. 17 and 18, results of simulations in which L=250 mm are shown.

As shown in FIGS. 14, 16, and 18, the positions of the representative points of the pedal 31 are changed as compared to those in the first embodiment. Therefore, it is possible to incline the ankle-joint angle in the dorsiflexion direction at an angle larger than that in the first embodiment. As described above, by providing the adjustment member 38, a user can perform an exercise at an appropriate ankle-joint angle(s).

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A foot-pedaling exercise apparatus comprising:

a rotation shaft rotatable about a rotational axis;

a crank connected to the rotation shaft;

a main-body part configured to rotatably hold the crank such that the crank is configured to rotate about the rotational axis of the rotation shaft;

a link rotatably connected to the crank, the link comprising a pedal configured for a sitting user to put his/her foot;

a moving member disposed in the link; and a first tilt table including an inclined surface on which the moving member moves, the inclined surface is a fixed inclined surface having a fixed inclination angle with respect to a horizontal floor surface, the first tilt table is disposed so as to be movable in a front-rear direction to change a distance between a front end of the first tilt table and the rotational axis of the rotation shaft.

2. The foot-pedaling exercise apparatus according to claim 1, wherein the first tilt table is disposed in such a manner that the first tilt table can be replaced with a second tilt table, the second tilt table including an inclined surface having at least one of a different inclination angle and a different shape than the first tilt table.

3. The foot-pedaling exercise apparatus according claim 1, wherein the crank, the link, the first tilt table, and the moving member are provided for each of left and right feet of the user, and at least one of a front-rear position, an inclination angle, and a shape of a left first tilt table is different from that of a right first tilt table.

4. The foot-pedaling exercise apparatus according to claim 1, wherein the moving member comprises a sliding wheel configured to move on the inclined surface.

5. The foot-pedaling exercise apparatus according to claim 1, wherein the fixed inclination angle raises moving from a front end towards a rear end in a front-rear direction.

* * * * *